US005881393A

United States Patent [19]

Marchello

[11] Patent Number: 5,881,393

[45] Date of Patent: Mar. 16, 1999

[54] HEADGEAR FOR WRESTLERS

[75] Inventor: John L. Marchello, Ann Arbor, Mich.

[73] Assignee: Danmar Products, Inc., Ann Arbor, Mich.

[21] Appl. No.: 17,553

[22] Filed: Feb. 2, 1998

[51] Int. Cl.[6] ..... A63B 71/10

[52] U.S. Cl. ..... 2/425; 2/209

[58] Field of Search ..... 2/410, 411, 412, 2/423, 425, 209, 421, 9

[56] References Cited

U.S. PATENT DOCUMENTS

| | | | |
|---|---|---|---|
| 2,898,596 | 8/1959 | Keen | 2/425 |
| 3,513,482 | 5/1970 | Holden | 2/425 |
| 3,588,914 | 6/1971 | Ihnat, Jr. | 2/209 |
| 3,596,288 | 8/1971 | Marchello | 2/425 |
| 3,728,741 | 4/1973 | Lepr | 2/209 |
| 4,551,861 | 11/1985 | Marchello | 2/425 |
| 4,710,985 | 12/1987 | Dubner et al. | 2/425 |
| 4,821,345 | 4/1989 | Marchello | 2/425 |
| 5,228,143 | 7/1993 | Marchello | 2/425 |
| 5,504,945 | 4/1996 | Purnell | 2/425 |
| 5,685,021 | 11/1997 | Tsujino | 2/425 |

*Primary Examiner*—Michael A. Neas
*Attorney, Agent, or Firm*—Harness, Dickey & Pierce, P.L.C.

[57] ABSTRACT

Headgear for wrestlers to cover and protect wrestler's ears and consisting of a pair of ear cover members, a plurality of straps to maintain the ear cover members in positions protecting the wrestler's ears, each of the cover members being comprised of a cup shape member having inner and outer surfaces and formed of a relatively hard shape retaining plastic foam material, a layer of soft conforming plastic foam on the inner surface of the cup shape member and having an inner surface shaped to conform to the shape of the wrestler's head in areas around the ears, a pair of inner and outer fabric members on the outer surface of the cup shape member and enveloping the plastic foam and providing a durable, washable and comfortable inner surface engagable with the wrestler's head and a tough, wear resistant color codable outer surface, and a plurality of hollow grommets extending through the ear cover members to provide sound passages to the ears of the wrestler.

2 Claims, 1 Drawing Sheet

HEADGEAR FOR WRESTLERS

BACKGROUND AND SUMMARY OF THE INVENTION

This invention relates generally to headgear for athletes and more particularly to headgear for wrestlers in which the ears of the wrestler are protected without inhibiting the movements of the wrestler and without creating any dangers for the wrestler's opponents.

Headgear for wrestlers usually consist of a pair of cup-shape ear covers and a plurality of straps adjustably secured to the covers and operable to maintain the covers in positions protecting the wrestler's ears. It is desirable that the ear covers are comfortably interfaced with the wrestler's head so that they are not a distraction during competition. Furthermore, it is desired that the covers protect the wrestler's ears from pressure applied directly to the covers. In addition, it is further required that the top and rear adjustment straps cooperate with a chin strap to insure the right location of the ear covers and maintain the ear covers in the correct position throughout a vigorous use of the helmet during competition. Prior art headgear can be improved and this invention provides such improvement.

It is the principal object of this invention to overcome the shortcomings in the prior art and provide headgear for wrestlers which is comprised of two semi-rigid ear cover members connected together by a plurality of retention straps which maintain the headgear in a stable position on the head of the wrestler for prolonged time periods even though the ear cover members are frequently in contact with the floor mat or the body of an opponent wrestler.

The ear cover members include foam molded ear cups comprised of differing layers of density but with all of the layers being from the same family of foam plastics so as to allow for bonding between the layers during the heating portion of a molding cycle. Outside laminates of fabric envelope the entire ear cover member and provide a durable, washable, and comfortable inner surface and a tough, wear-resistant color codable outer surface.

The cup shape of the ear cover enables the provision of four recessed grommets in the finished holes of the cover that provide sound passageways to the ear without any sharp edges or surfaces. A contoured inner ear section comprised of a soft conforming foam with a laminated fabric exterior that extends beyond the outer circumference of the ear cup provides a better distribution of impact forces by closely matching the contours of the head/jaw areas of the wrestler. A set of top and rear adjustment straps constructed of a semi-flexible polypropylene webbing with Velcro adjustment sections and a set of keepers strapped at each end. Keeper straps made of soft non-stretch webbing and sewn in such a manner as to eliminate harsh edges provide a method of keeping the two adjustment straps from pulling apart under stress.

The top and rear adjustment straps being of a different material than the ear cover member and attached by sewing during the assembly of the headgear can be used in different colors to provide a variety of two-tone color variations matching individual team uniforms. A throat strap comprised of a soft webbing attached to the lower comer of one ear cover member and a plastic loop attached to the other cover member is attached by means of a short folded length of webbing sewn to the lower comer of the other ear cup. VELCRO (namely, hook and loop fastener) sections sewn to the outer side of the throat strap allow for individual size adjustment when the strap is passed through the plastic loop and folded back upon itself and the hook and loop fastener sections.

In summary, therefore, the headgear for wrestlers of this invention provides not only for a stable positioning of the headgear on the wrestler but also provides ear covers which have soft molded surfaces which engage the wrestler's head in the ear area are comfortable and maintain space in the ear cover so that the wrestler can hear through the hollow grommets. The outside laminates of fabric which envelope the entire ear cover member provide a durable, washable, tough, wear-resistant surface which will glide over a wrestling mat surface easily.

Further advantages and features of the present invention will become apparent to those skilled in the art to which this invention relates from the following description of the preferred embodiment and the appended claims, taken in conjunction with the accompanying drawings.

DESCRIPTION OF THE PREFERRED EMBODIMENT

Figure 1:
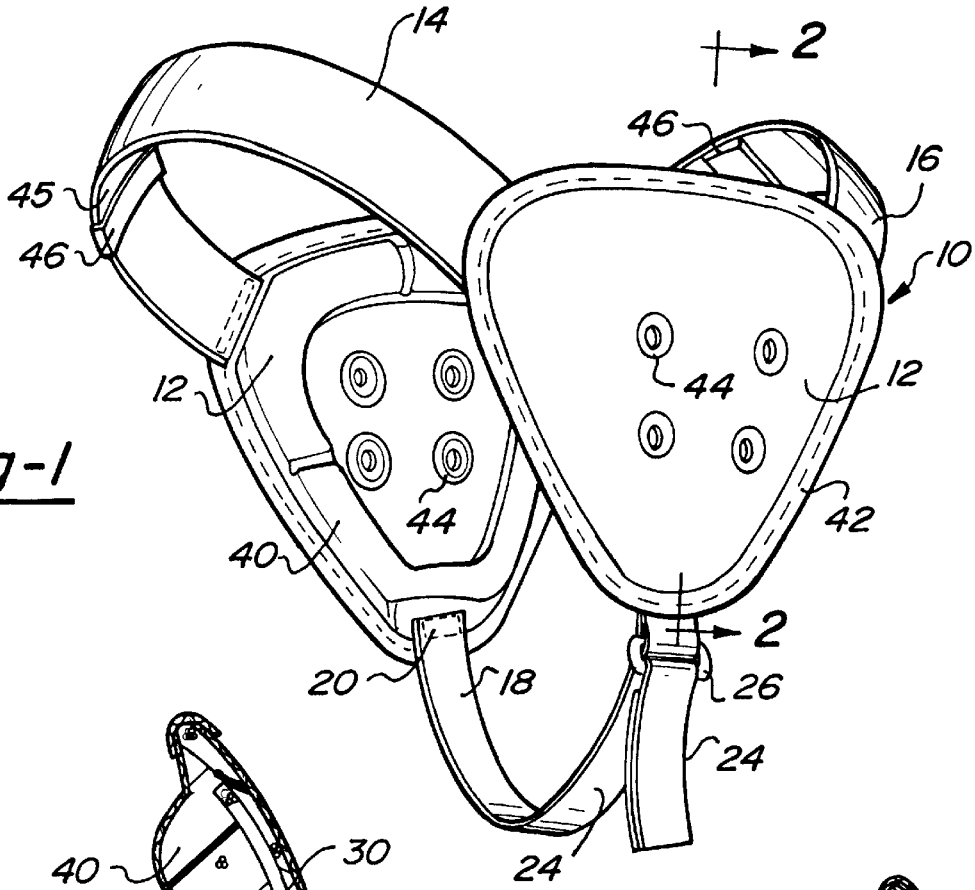
FIG. 1 is a pictorial view of an improved headgear for wrestlers in accordance with the present invention.
Figure 2:
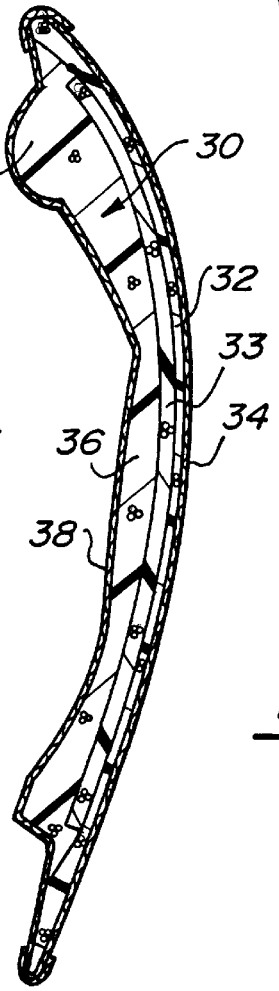
FIG. 2 is an enlarged sectional view of an ear cover member in the headgear of this invention as seen from substantially the line 2—2 in FIG. 1.

With reference to the drawing, the wrestler's headgear of this invention, indicated generally at 10 in FIG. 1, is comprised of two identical ear cover members 12 connected together by a top adjustment strap 14 and a rear adjustment 16. A chin strap 18 is sewn at one end 20 to one of the ear covers. The opposite end of the chin strap 18 has a VELCRO or other hook and loop fastener section. 24 and is extended through a plastic loop 26 secured to the other ear cover member 12. The throat strap 18 enables individual size adjustment of the headgear 10 when the strap 18 is extended through the plastic loop and folded back upon itself so that the Velcro section 24 locks to a similar Velcro section on the strap 18.

Each of the ear cups 12 consists of a shaped body 30 of plastic foam. The body 30 is made up of a plurality of layers. An outer layer 32 is part of a fabric laminate 34 which is formed of tough, wear-resistant, color codable cloth material. The body 30 also includes an inner layer 36 of soft, conforming foam with a laminating fabric exterior 38 that extends beyond the outer circumference of the ear cup to provide a better distribution of impact forces by closely matching the contours of the body 36 to the head/jaw areas of the wrestler's head. The inwardly extending protrusion 40 on the layer 36 of soft conformable foam extends around the periphery of the ear cover member and is interrupted only were the chin strap 20 and the plastic loop 26 are secured to the lower ends of the members 12. A very firm foam layer 33 is located between the layers 32 and 36. The layers 32 and 33 are made of structural foam so that they can maintain the cup shape of the cover members 12. A cloth rim member 42 extends around the outer edge of each of the cover member 12.

Figure 3:
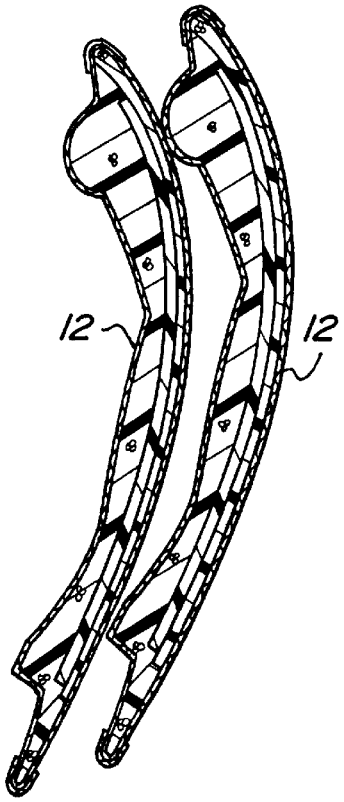
FIG. 3 is a cross sectional view of the two ear cover members in the head gear shown in FIG. 1 with the ear cover members stacked one within the other to facilitate shipment and storage of the headgear of this invention.

As shown in FIG. 3 of the drawing, the cup shape ear cover members 12 can be stacked one within the other to facilitate storage and shipping of the headgear 10. Each ear cover includes four grommets 44 which extend through the outer fabric 34, the foam body 30 and the inner fabric 38 to maintain the ear cup components in desired relative position. The grommets 44 are hollow so they also enable the wrestler to hear through the members 12.

From the above description, it is apparent that this headgear 10 provides an improved ear guard assembly for wrestlers. The shaped foam body 30 provides a durable and comfortable inner surface that engages the head of the wrestler and the stiffer, harder layers 32 and 33 maintain the cup shapes of the cover members 12. The straps 14, 16 extend between and are sewed to the ear cover members 12. Each adjustment strap is constructed of a semi-flexible polypropylene webbing with hook and loop fastener sections 45 at their ends which overlap and are encircled by annular keepers 46. This enables adjustment of the lengths of the straps 14 and 16.

While the above description constitutes the improved embodiment of the present invention, it will be appreciated that the invention is susceptible to modification, variation and change without departing from the proper scope and fair meaning of the accompanying claims.

I claim:

1. A headgear for wrestlers to cover and protect the wrestler's ears, said headgear comprising:

a pair of ear cover members, a plurality of adjustable straps secured to said cover members to maintain said ear cover members in positions protecting the wrestler's ears, each of said cover members being comprised of a cup shape member having inner and outer surfaces and formed of a relatively hard shape retaining plastic foam material, a layer of soft conforming plastic foam on the inner surface of said cup shape member and having an inner surface shaped to conform to the shape of the wrestler's head in areas around the ears, a pair of inner and outer fabric members on the outer surface of said cup shape member and covering the inner surfaces of said plastic foam and providing a durable, washable and comfortable inner surface engageable with the wrestlers head and a tough, wear resistant color codable outer surface, a plurality of hollow grommets extending through said ear cover members to provide sound passages to the ears of the wrestler, said plurality of straps including top and rear adjustment straps constructed of semi-flexible polypropylene webbing, each of said straps consisting of a pair of strap members, each being secured to one of said ear cover members and having hook and loop fastener sections which overlap and are squeezed together to maintain a desired effective length for the adjustment strap.

2. The headgear according to claim 1 wherein the headgear further includes a throat strap consisting of soft webbing attached to the lower comer of one cup and a plastic loop attached to the other cup, the throat strap being of a length to be passed through the plastic loop and folded back upon itself, and hook and loop fastener sections secured to the throat strap so that when the throat strap is folded back upon itself, the hook and loop fastener sections can be squeezed together to maintain a desired length of the throat strap.

* * * * *